US007546875B2

(12) United States Patent
Whitsitt et al.

(10) Patent No.: US 7,546,875 B2
(45) Date of Patent: Jun. 16, 2009

(54) INTEGRATED SAND CONTROL COMPLETION SYSTEM AND METHOD

(75) Inventors: John Whitsitt, Houston, TX (US); Vladimir Vaynshteyn, Sugar Land, TX (US); Steven W. Henderson, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 190 days.

(21) Appl. No.: 11/279,832

(22) Filed: Apr. 14, 2006

(65) Prior Publication Data

US 2007/0240881 A1 Oct. 18, 2007

(51) Int. Cl.
*E21B 43/04* (2006.01)
*E21B 43/11* (2006.01)

(52) U.S. Cl. ..... 166/278; 166/297; 166/55.1; 166/227

(58) Field of Classification Search ..... 166/278, 166/297, 51, 55.1, 227
See application file for complete search history.

(56) References Cited

U.S. PATENT DOCUMENTS 4,372,384 A * 2/1983 Kinney ..... 166/278
4,540,051 A 9/1985 Schmuck et al.
5,174,379 A * 12/1992 Whiteley et al. ..... 166/278
5,224,556 A 7/1993 Wilson et al.
5,329,998 A * 7/1994 King et al. ..... 166/51
5,505,260 A * 4/1996 Andersen et al. ..... 166/278
5,603,378 A * 2/1997 Alford ..... 166/222
5,845,712 A * 12/1998 Griffith, Jr. ..... 166/278
6,009,947 A 1/2000 Wilson et al.
6,095,245 A * 8/2000 Mount ..... 166/276
6,176,307 B1 * 1/2001 Danos et al. ..... 166/51
6,189,616 B1 * 2/2001 Gano et al. ..... 166/298
6,386,388 B1 5/2002 Overholt
6,557,636 B2 5/2003 Cernocky et al.
6,568,474 B2 5/2003 George et al.
6,675,893 B2 * 1/2004 Lund ..... 166/278
6,755,249 B2 6/2004 Robison et al.
6,761,219 B2 * 7/2004 Snider et al. ..... 166/297
6,837,310 B2 * 1/2005 Martin ..... 166/297

(Continued)

FOREIGN PATENT DOCUMENTS

GB 2397594 A 7/2004

(Continued)

*Primary Examiner*—David J Bagnell
*Assistant Examiner*—Cathleen Hutchins
(74) *Attorney, Agent, or Firm*—Winstead PC; Kevin B. McGoff; James L. Kurka

(57) ABSTRACT

An integrated sandface completion tool that can be positioned within a wellbore in a single trip and a method of providing a sandface completion in a wellbore. An embodiment of the integrated sandface completion tool includes a casing section having a casing wall, at least one explosive charge connected to the casing wall, and a screen assembly connected within the casing section forming a screen-casing annulus, the screen assembly having openings formed along a portion thereof and a port in selective communication with the screen-casing annulus. The method includes the steps of positioning the integrated completion tool in the wellbore, detonating the explosive charge and packing the screen-casing annulus with a material.

20 Claims, 1 Drawing Sheet

U.S. PATENT DOCUMENTS

| | | | | |
|---|---|---|---|---|
| 6,962,202 | B2 | 11/2005 | Bell et al. | |
| 2002/0092649 | A1* | 7/2002 | Bixenman et al. | 166/278 |
| 2004/0251024 | A1 | 12/2004 | Jones | |
| 2005/0194143 | A1 | 9/2005 | Xu et al. | |
| 2005/0263286 | A1* | 12/2005 | Sheffield | 166/297 |
| 2007/0044964 | A1* | 3/2007 | Grigar et al. | 166/278 |

FOREIGN PATENT DOCUMENTS

| | | | |
|---|---|---|---|
| GB | 2407111 | A | 4/2005 |
| GB | 2429726 | A | 3/2007 |

* cited by examiner

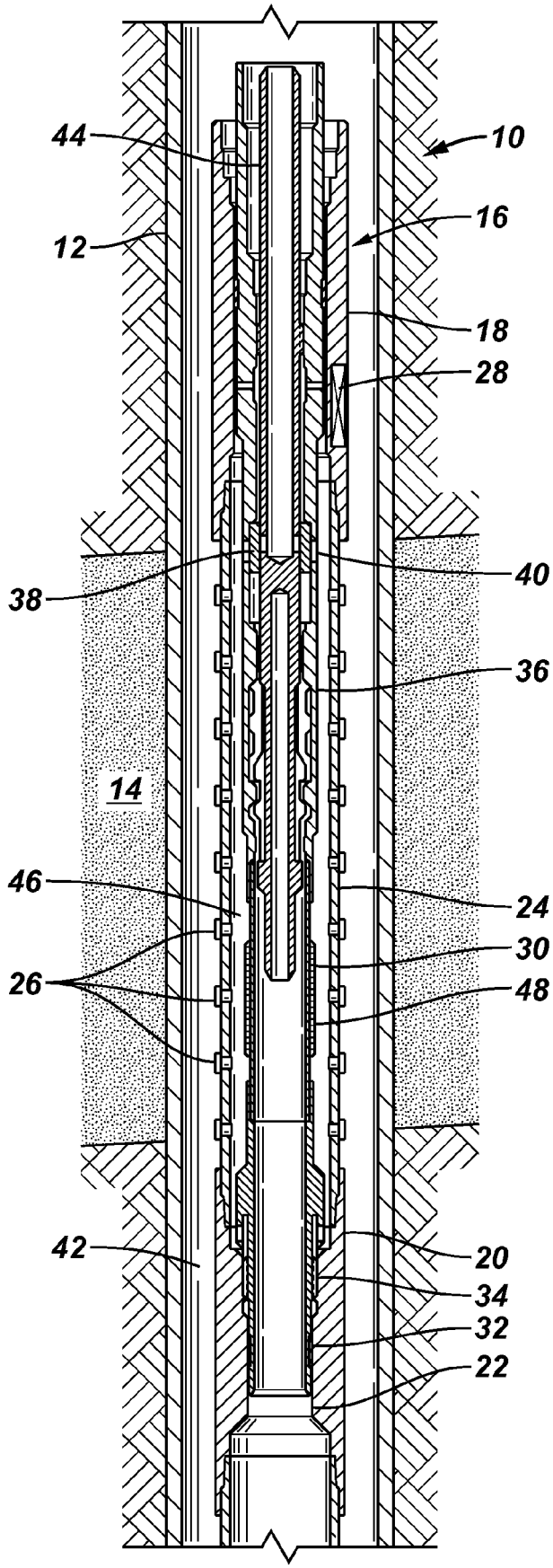
44
10
16
12
18
28
40
38
36
14
46
24
30
26
48
42
20
34
32
22

INTEGRATED SAND CONTROL COMPLETION SYSTEM AND METHOD

FIELD OF THE INVENTION

The present invention relates in general to well completion systems and methods and more specifically to integrated sandface completion tools that convey a casing section, perforating mechanism and sand screen assembly and methods for limiting deployment time and fluid loss during completion operations.

BACKGROUND

In the drilling and completion of wells, it is common to cement a casing in the wellbore, perforate the casing and to gravel pack the desired section of the casing string to provide sand control. Typically these operations require multiple trips into the well, thus increasing the cost of completing the well. Rig time and costs are further increased for wells having multiple pay zones. Additionally, conventional completion systems and methods often result in the bypass of pay zones in multiple zone wellbores due to the spatial limits of placement of the completion equipment. Still further, the prior art completion systems often result in undesirable fluid loss during completion operations.

It is thus a desire to provide an integrated tool and method for sandface completions that limits deployment time and fluid loss.

SUMMARY OF THE INVENTION

Accordingly, integrated sandface completion tools and methods of providing a sandface completion in a wellbore are provided. An embodiment of an integrated sandface completion tool that can be positioned within a wellbore in a single trip includes a casing section having a casing wall, at least one explosive charge connected to the casing wall and a screen assembly connected within the casing section forming a screen-casing annulus, the screen assembly having openings formed along a portion thereof and a port in selective communication with the screen-casing annulus.

An embodiment of a method for providing a sandface completion in a wellbore includes the steps of providing an assembled integrated sandface completion tool having a casing section, at least one explosive charge connected to a wall of the casing section and a screen assembly connected within the casing section forming a screen-casing annulus and having openings formed along a portion thereof, positioning the integrated sandface completion tool in the wellbore, detonating the at least one explosive charge and packing the screen-casing annulus with a material.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein:

FIG. 1 is a schematic view of an embodiment of an integrated sandface tool of the present invention.

DETAILED DESCRIPTION

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic view of an embodiment of an integrated sandface completion tool of the present invention, generally designated by the numeral 10, positioned in a wellbore 12. Wellbore 12 penetrates the earth and at least one formation, or pay zone 14, which it is desired to produce from or inject into. It should be recognized that wellbore 12 may include vertical, deviated or horizontal sections and multiple pay zones 14. Integrated tool 10 is shown and described herein with reference to a single pay zone 14, however it should be readily recognized that the tool and method of the present invention is intended for multiple pay zone wells and provides advantages over prior completion systems.

Integrated sandface completion tool 10 includes a casing section 16 and a sand screen assembly 30. Casing section 16 is the portion of a casing string (not shown) adapted to be positioned proximate the desired pay zones. Screen assembly 30 is assembled within casing section 16 to form an integrated sandface completion tool before it is run into wellbore 12. Integrated tool 10 may be assembled at a shop or assembled at the well site, for example when the tool length does not permit ground transport from a remote location.

Casing section 16 includes a top adapter 18 and a bottom adapter 20. Top adapter 18 includes a polish bore on the inside diameter. Bottom adapter 20 includes a polish bore and an internal latching thread 22. Casing section 16 includes an elongated casing wall 24. Casing wall 24 may extend the length or substantially the length of pay zone 14.

Explosive charges 26 are provided along and carried by casing wall 24 to perforate casing section 16 and any surrounding cement to provide fluid flow paths between pay zone 14 and the interior of tool 10. In the present embodiment, explosive charges 26 are capsule charges, which are individually fitted to casing wall 24. The number of capsule charges 26 provided and the capsule charge 26 pattern may be varied in accordance with the particular well characteristics. A firing head 28 is operationally connected to each of the capsule charges 26 by a detonation mechanism (not shown) such as, but not limited to, detonation cord or telemetry devices. Firing head 28 may be carried by top adapter 18. In a multiple zone wells, a firing head 28 may be provided for each pay zone 14, facilitating perforating and packing each pay zone separately.

Sand screen assembly 30 includes a seal 32, mechanical latching device 34, go-nogo collar 36, a port closing sleeve 38 and a communication port 40. Sand screen assembly 30 is connected within casing section 16 such that an annulus 46 is defined between sand screen assembly 30 and casing section 16. Screen-casing annulus 46 extends substantially the length of pay zone 14 or more specifically the length of casing wall 28 that carries charges 26.

Port closing sleeve 38 is moveable for selectively opening communication port 14 for disposing a packing material within screen-casing annulus 46. As is well known in the art, sand screen assembly 30 further includes pre-formed openings 48 along at least a portion thereof. Openings 48 are sized so as to not pass the selected packing material therethrough.

An embodiment of a method of limiting deployment time and reducing fluid loss during a sandface completion is provided. Integrated tool 10, is assembled on a per pay-zone 14 basis by assembling screen assembly 30 within casing section 16. Casing section 16 is fitted with capsule charges 26 on its wall. Charges 26 are operationally connected to firing head 28 carried by casing section 16.

Integrated sandface tool 10 is run into wellbore 12 and positioned adjacent to pay zone 14. Sandface tool 10 is cemented in place by running into wellbore 12 and tool 10 with a cement string (not shown) and displacing cement into annulus 42 behind casing section 16. The cement string is then pulled out of wellbore 12.

Casing section 16 and the cement placed in annulus 42 is then perforated. The perforating operation includes running into wellbore 12 with a service string 44. Service string 44 is positioned within screen assembly 30 using go-nogo collar 36. Firing head 28 is then actuated to detonate capsule charges 26. Firing head 28 may be actuated by pressuring up via service string 44.

The annulus 46 between sand screen assembly 30 and casing section 16 is then packed to provide sand control. By gravel packing substantially immediately after perforating, fluid loss is limited and reduced relative to conventional completion methods. The step of gravel packing includes shifting port closing sleeve 38 to open communication port 40. Port closing sleeve 38 may be shifted by mechanical manipulation via service string 44 or pressuring up. With communication port 40 open, packing material is injected into annulus 46. When the pack is complete, service string 44 is pulled until communication port 40 is above the polished bore of top adapter 18.

From the foregoing detailed description of specific embodiments of the invention, it should be apparent that an integrated sandface completion system and method for limiting the deployment time and fluid loss in a sandface completion that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions alterations, and/or modifications, including but not limited to those implementation variations which may have been suggested herein, may be made to the disclosed embodiments without departing from the spirit and scope of the invention as defined by the appended claims which follow.

What is claimed is:

1. An integrated sandface completion tool that can be positioned within a wellbore in a single trip, the tool comprising:

a casing section having a casing wall;

at least one explosive charge carried by the casing wall; and a screen assembly connected within the casing section forming a screen-casing annulus, the screen assembly having openings formed along a portion thereof and a port in selective communication with the screen-casing annulus.

2. The tool of claim 1, wherein the at least one explosive charge is a capsule charge individually fitted to the casing wall.

3. The tool of claim 1, further including a firing head carried by the casing section operationally connected to the at least one explosive charge.

4. The tool of claim 3, wherein the at least one explosive charge is a capsule charge individually fitted to the casing wall.

5. The tool of claim 1, wherein the screen-casing annulus is elongated.

6. The tool of claim 2, wherein the screen assembly includes a moveable sleeve for selectively opening and closing the port.

7. The tool of claim 4, wherein the screen assembly includes a moveable sleeve for selectively opening and closing the port.

8. The tool of claim 1, wherein the casing section further includes a top adapter connected to the casing section, the top adapter having an internal polish bore.

9. The tool of claim 8, wherein the at least one explosive charge is a capsule charge individually fitted to the casing wall.

10. The tool of claim 9, further including a firing head in operational connection with the at least one capsule charge, the firing head being carried by the top adapter.

11. A method for providing a sandface completion in a wellbore, the method comprising the steps of:

providing an assembled integrated sandface completion tool having a casing section, at least one explosive charge carried by a wall of the casing section and a screen assembly connected within the casing section forming a screen-casing annulus and having openings formed along a portion thereof;

positioning the integrated sandface completion tool in the weilbore;

detonating the at least one explosive charge; and packing the screen-casing annulus with a material.

12. The method of claim 11, wherein the screen-casing annulus is elongated.

13. The method of claim 11, wherein the step of packing the screen-casing annulus includes opening a port through the screen assembly in communication with the screen-casing annulus.

14. The method of claim 13, wherein the screen-casing annulus is elongated.

15. The method of claim 11, wherein integrated sandface completion tool further includes:

a top adapter connected to the casing section; and a firing head connected to the top adapter and operationally connected to the at least one explosive charge.

16. The method of claim 15, wherein the screen-casing annulus is elongated.

17. The method of claim 11, wherein the at least one explosive charge is a capsule charge individually fitted to the casing wall.

18. The method of claim 14, wherein the at least one explosive charge is a capsule charge individually fitted to the casing wall.

19. A method for providing a sandface completion in a wellbore, the method comprising the steps of:

providing an assembled integrated sandface completion tool having a casing section with an elongated casing wall and a top adapter, a plurality of explosive charges carried by the casing wall, a firing head carried by the top adapter, the firing head operationally connected to the plurality of explosive charges, a screen assembly connected within the casing section forming an elongated screen-casing annulus, the screen assembly including openings formed along a portion thereof and a port formed through the screen assembly in selective communication with the screen-casing annulus;

positioning the assembled integrated sandface completion tool in the wellbore;

cementing the assembled integrated sandface completion tool in the wellbore;

running a service string into the assembled integrated sandface completion tool;

detonating the explosive charges;

opening the port;

packing the screen-casing annulus with a material;

closing the port; and pulling the service string out of the wellbore.

20. The method of claim 19, wherein the plurality of explosive charges are capsule charges individually fitted on the casing wall.

* * * * *